United States Patent [19]

Terstegge

[11] Patent Number: 4,593,892

[45] Date of Patent: Jun. 10, 1986

[54] QUICK CLOSING VISE ASSEMBLY FOR MILLING MACHINE

[76] Inventor: Theodore E. Terstegge, 103 Tara Rd., Orinda, Calif. 94563

[21] Appl. No.: 642,151

[22] Filed: Aug. 20, 1984

Related U.S. Application Data

[63] Continuation-in-part of Ser. No. 429,225, Sep. 30, 1982, abandoned.

[51] Int. Cl.[4] ..... B25B 5/10
[52] U.S. Cl. ..... 269/244; 81/73
[58] Field of Search ..... 269/244; 81/73

[56] References Cited

U.S. PATENT DOCUMENTS

| | | | |
|---|---|---|---|
| 1,279,011 | 9/1918 | Sanford | 269/244 X |
| 1,326,526 | 12/1919 | Oysler | 81/73 X |
| 1,406,901 | 2/1922 | Rocher | 269/244 X |
| 4,046,364 | 9/1977 | Coope et al. | 269/244 |

*Primary Examiner*—James G. Smith
*Attorney, Agent, or Firm*—Flehr, Hohbach, Test, Albritton & Herbert

[57] ABSTRACT

For use with a low profile vise assembly of a type adapted to be carried on the support table of a milling machine or similar equipment, an operating handle engages a drive nut portion of the vise screw and extends diagonally away from the axis of the screw at a relatively low angle whereby the outer end of the operating handle is free to rotate continuously through 360° so as to quickly move the sliding jaw of the vise.

3 Claims, 6 Drawing Figures

QUICK CLOSING VISE ASSEMBLY FOR MILLING MACHINE

This is a continuation-in-part of pending application Ser. No. 429,225, filed Sept. 30, 1982 now abandoned.

This invention pertains to vises of a type primarily used with milling machines and more particularly to such a vise employing an improved handle for rapidly closing the jaws of the vise.

Vises commonly used in connection with a milling machine are carried on the milling machine's support table. Such a vise should be as low as it is possible to make it, so that the work piece can be close to the table where cutting stresses can be withstood more readily. An elongate vise screw rotated by a handle carried on its outer end operates a sliding jaw to move between advanced and retracted positions relative to a fixed jaw.

Frequently, due to the low profile of the vise and the proximity of the axis of the vise screw to the table, the handle can only rotate the screw substantially less than a full turn before the handle engages the table. At that point, the handle must be reoriented on the screw to provide each subsequent limited rotation of the screw. Obviously, movement of the sliding jaw is slow and time consuming to the operator using such an arrangement. The problem becomes particularly annoying when the operator changes the setting of the jaws from a relatively small work piece to a large work piece (or vice versa).

As disclosed herein a vise assembly for use on a milling machine has been provided characterized by a handle which permits continuous rotation of the vise screw.

SUMMARY OF THE INVENTION AND OBJECTS

In general, a low profile vise assembly of a type adapted to be mounted to the table of a milling machine includes the usual vise screw for operating the sliding jaw of the vise. The outer end of the vise screw includes flat sides to form a drive nut portion of the screw. A handle carried from the drive nut portion serves to rotate drive screw through 360 degrees continuously without requiring reorientation of the handle on the drive nut portion. The handle includes means forming an enclosed socket for receiving the drive nut portion therein in a manner fully supporting the handle. An elongate shank integral with the socket extends diagonally away from the axis of the screw. The free end of the shank is rotatable through 360° above the table to premit continuous rotation of the handle and screw to rapidly close the jaws of the vise.

It is a general object of this invention to provide an improved quick closing vise assembly of a type adapted for use on a milling machine or similar equipment.

It is a further object of the invention to provide a quick closing vise assembly of the kind described characterized by an improved closure handle for rapidly closing or opening the jaws of the vise.

Another object of the invention is to provide a handle adapted to be readily removably mounted to a vise screw in a manner permitting uninterrupted continuous rotation of the vise screw with the vise supported upon a table.

Another object of the invention is to provide such a removable vise handle having means for applying substantial torque to initially open and finally close the vise jaws relative to a work piece as well as means for rapidly moving the vise jaws relative to each other.

The foregoing and other objects of the invention will become more readily evident from the following detailed description of preferred embodiments when considered in conjunction with the drawings.

DESCRIPTION OF PREFERRED EMBODIMENTS

Figure 1:
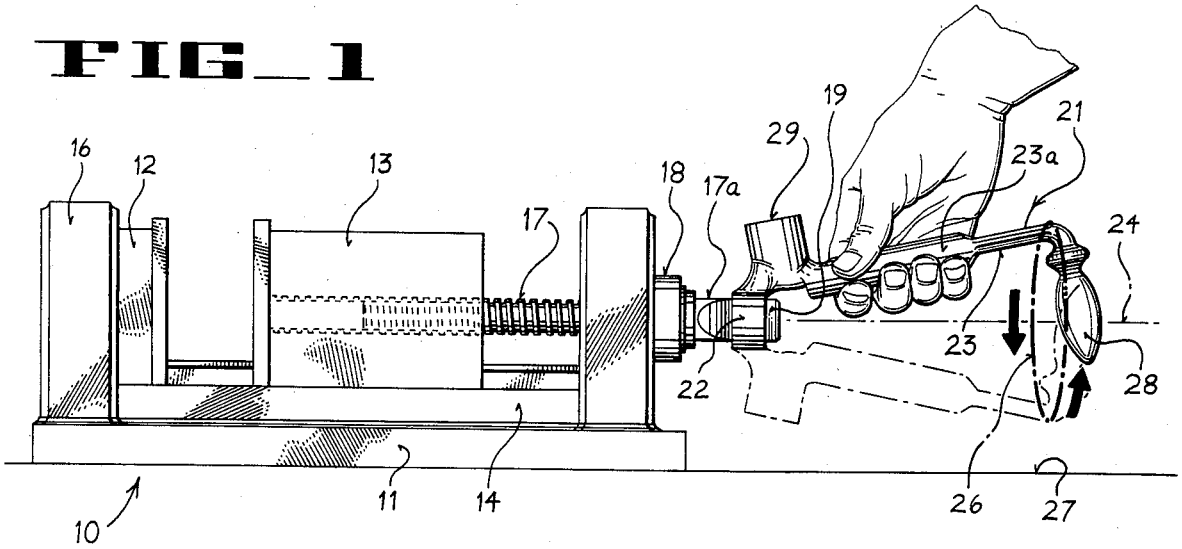
FIG. 1 shows a diagrammatic side elevation view of a low profile vise assembly of a type employed on the table of a milling machine and having an improved handle, according to the invention.

The quick closing vise assembly 10 shown in FIG. 1 includes a rigid base 11. A rigid bed or slide plate 14 carries a fixed jaw 12 and a sliding or movable jaw 13. Jaw 13 is mounted to slide along the upper surface of plate 14 between advanced and retracted positions with respect to fixed jaw 12. A rigid abutment 16 extending upwardly from base 11 serves to mount the fixed jaw 12.

Means for moving sliding jaw 13 between advanced and retracted positions relative to jaw 12 include the vise screw 17 journaled in bearing assembly 18 for rotation and threadadly moving jaw 13.

The outer end of vise screw 17 has been formed to include a plurality of flats 19 defining a drive nut portion 17*a*.

Means for quickly moving jaw 13 with respect to jaw 12 includes an operating handle 21 carried at one end by drive nut portion 17*a*. Accordingly, operating handle 21 includes an annular body 22, or head, of rigid material. A socket formed to include flats therein disposed to correspond to the flats of drive nut portion 17*a* is provided within body 22. Body 22 preferably is open at both ends thereof so as to be adapted to receive drive nut portion 17*a* therein in a manner supporting operating handle 21 therefrom.

An elongate shank 23 carried by annular body 22 serves to rotate body 22 and the socket carried or formed therein. The shank extends diagonally away from the axis 24 of vise screw 17. The free end of shank 23 is free to rotate through 360° as shown by the circle 26 in phantom lines. Rotation of the free end of shank 23 remains above and overlies the plane of base 11. It is further evident that the top surface 27 of a support table of a milling machine or similar equipment will not engage operating handle 21 as it is rotated since handle 21 also remains above the surface of support table 27.

Shank 23 includes a cylindrical elongate body 23*a* having a diameter adapted to be readily held between the operator's thumb and fingertips. Body 23*a* has a length corresponding at least to the aggregate width of four fingers of a person's hand as shown in FIG. 1. The outer surface of the enlarged cylindrical body 23*a* is smooth to readily permit shank 23 to rotate between the operator's thrumb and fingertips as the operator's hand moves in a small circle to rotate nut portion 17*a*. Thus it will be observed that the person's hand will traverse a relatively small circle while driving jaw 13 in one direction or the other.

Once jaw 13 has been moved to the approximate position for holding the work piece between jaws 12, 13, operating handle 21 provides additional means for tightening the two jaws firmly upon the work piece or for initially releasing a previously applied grip as now to be described.

Accordingly, operating handle 21 includes a grip 28 extending substantially normal to shank 23. A high torque socket is formed within the annular body 29 carried by shank 23 and extending normal thereto in a direction opposite from the direction of grip 28.

Accordingly, when it is desired to apply substantial torque to the drive screw 17 for either tightly closing the two jaws or for initiating the opening of the two jaws from a previously gripped work piece, operating handle 21 is removed from drive nut 17*a* and the socket within body 29 is fitted over drive nut 17*a*. In this configuration, maximum leverage is attained using the full length of shank 23.

Figure 2:
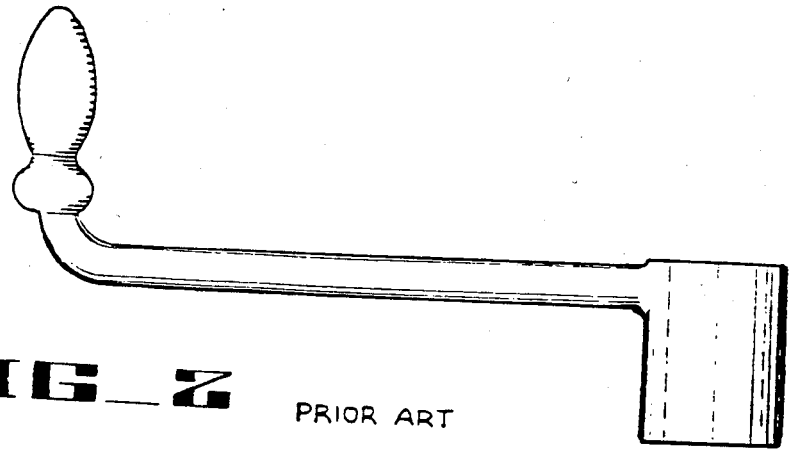
FIG 2 PRIOR ART
FIG. 2 shows a side elevation view of a prior art handle for a vise.
Figure 3:
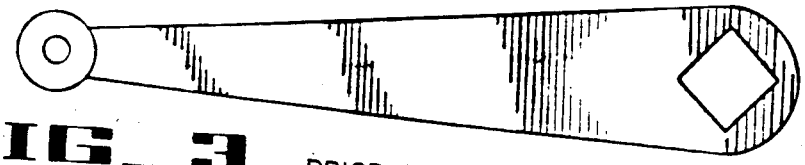
FIG 3 PRIOR ART
FIG. 3 shows a top plan view of the prior art vise handle shown in FIG. 2.

A prior art handle is shown in FIGS. 2 and 3 for comparison.

Figure 4:
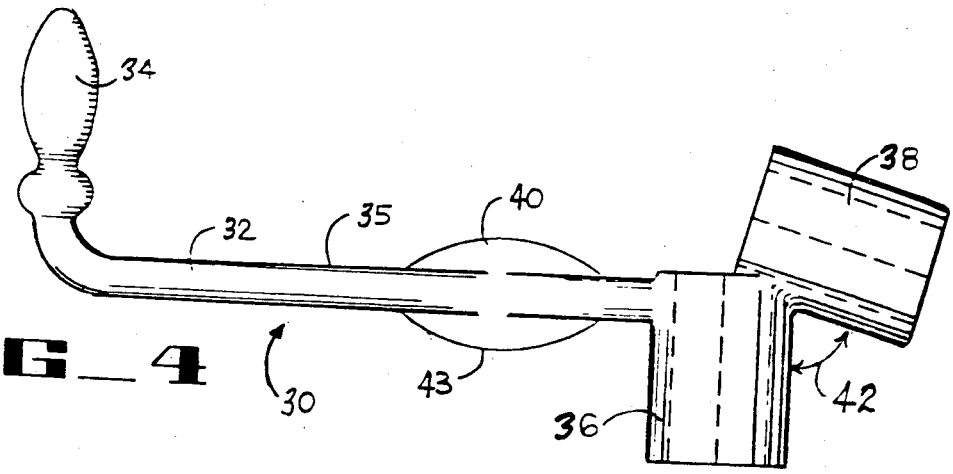
FIGS. 4 and 5 respectively show side elevation and top plan views of the improved operating handle of the vise assembly as shown in FIG. 1.
Figure 5:
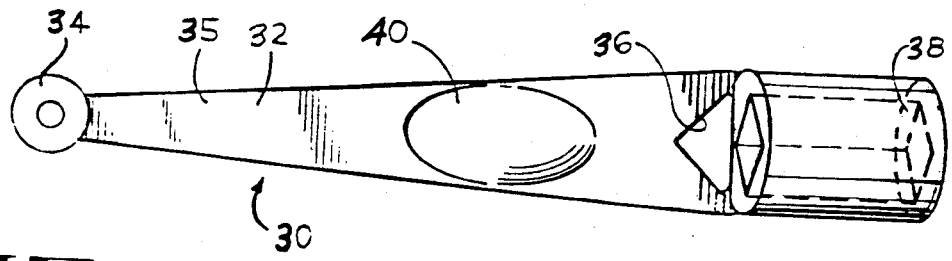

According to another embodiment as best shown in FIGS. 4 and 5, an operating handle 30 includes a shank 32 with a turning grip 34 fixed to shank 32 at one end thereof. Grip 34 is preferably formed as a unitary portion of shank 32 and extends outwardly therefrom at an angle of approximately 90° from the top side 35 thereof (as shown).

The other end of shank 32 carries a first socket 36 fixed thereto. The first socket 36 extends from shank 32 in a direction opposite to that of grip 34.

A second socket 38 is fixed at the same end of shank 32 as socket 36. Socket 38 is preferably fixed to the top of socket 36 and disposed at an angle 42 of slightly less than 90° with respect thereto.

Both sockets 36 and 38 are shown as having four internal "flats" or faces. However, it is to be understood that each of these sockets could contain any number of faces, depending on the shape of the drive nut for the vise or other holding device to be operated by the operating handle 30.

To enable handle 30 to be readily gripped and/or guided when being turned, shank 32 carries rounded and raised gripping or holding portions extending from opposite sides of shank 32, as indicated by numerals 40, 43. This gripping or holding portion enables the shank to be gripped by the fingers during rotation. The dome shaped portions 40, 43 have been observed to be quite satisfactory for manipulating handle 30 using socket 38.

As noted above, socket 38 is fixed to the end of shank 32 at an angle 42 of less than 90° with respect to socket 36. Preferably, the angle between the two sockets lies between approximately 70° and 85°. Use of operating handle 30 with socket 36 functions as a regular crank type handle to apply maximum torque to the vise screw to open or close a vise. If it is desired to quickly open or close the vise, at a speed which has been observed to be some twenty times as fast as when using socket 36, socket 38 may be used. With socket 38 mounted on the drive nut of a vise or the like, shank 32 will extend therefrom at a slight angle from the axis of the turning nut of the vise. At this angle, handle 30 may be gripped by the fingers of one hand of the user at the enlarged raised portions 40, 43 and turned in a small orbit to quickly open or close the vise. Also, at this slight angle with respect to the turning nut axis of the vise, grip 34 may be rotated by one hand while the fingers of the other hand are used to grip raised portions 40, 43 to either help to turn the handle or to guide or steady it when it is being turned by grip 34.

Figure 6:
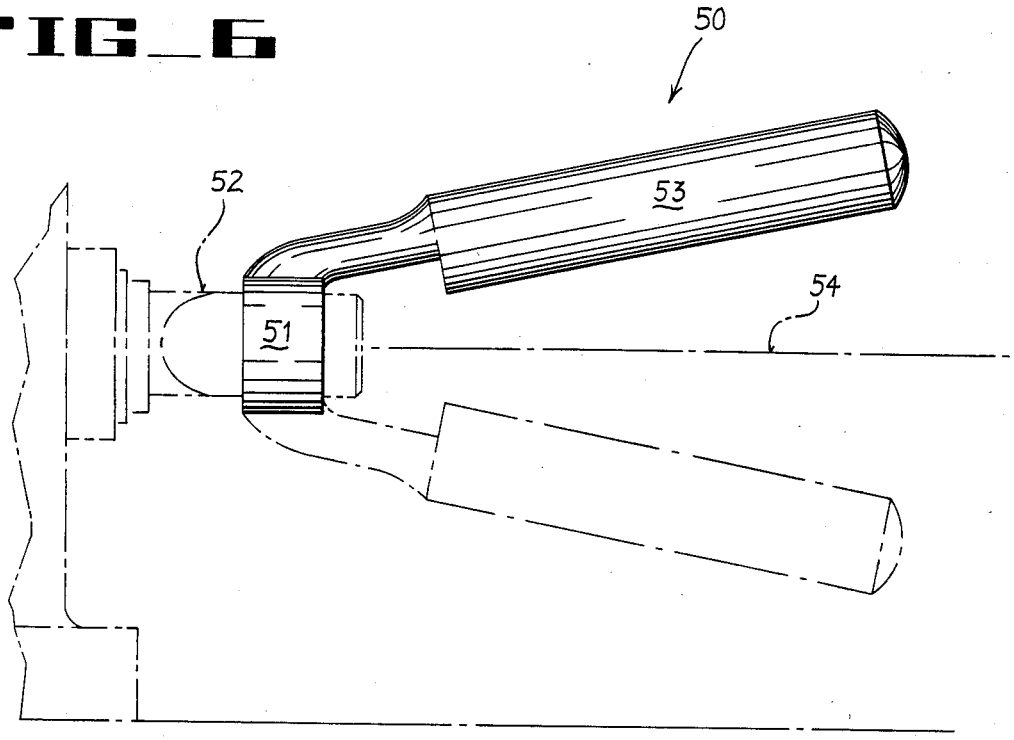
FIG. 6 shows another embodiment of the operating handle for a vise as shown in FIG. 1.

According to another embodiment as shown in FIG. 6, an operating handle 50 for driving a vise screw in the manner shown above includes an annular socket body 51 of rigid material formed with internal flats for engaging corresponding flats on the protruding drive nut portion 52. Handle 50 includes an elongate cylindrical shank portion 53 formed with a smooth exterior surface and having a length at least corresponding to the width of four fingers of a person's hand. Shank 53 extends at a slight angle to the axis 54 of drive nut 52 and to that of the vise screw (which is not shown).

It will be readily evident that in operation as shank 53 is moved about axis 54 the operator's hand will need to move only a limited distance about the small circle which is traced by the outer end of shank 53. The amount of hand movement can be further reduced by gripping shank 53 closer to socket body 51. It will be further evident that the handle is fully supported from one end whereby operation of the vise can be managed by using only one hand of the operator. This permits the operator to employ his other hand to properly position the work piece between the jaws of the vise or otherwise.

From the foregoing it will be readily evident that there has been provided an improved quick closing vise assembly employing an improved operating handle for rapidly operating the jaws of the vise to close or open with respect to a work piece disposed therebetween. The operating handle is arranged to extend diagonally from the axis of a vise screw to an extent sufficient to attain enough leverage to operate the screw while at the same time preventing the handle from engaging the support table of the milling machine or other similar equipment supporting the vise. In this way the handle can be continuously operated through 360 degrees and the extent of hand movement will be relatively limited so as to provide relatively rapid movement of the jaws of the vise.

I claim:

1. In a vise assembly comprising a base, a pair of jaw members, one of said members being fixed with respect to said base, the other said member being movable between advanced and retracted positions with respect to said one member, an elongate vise screw threadedly coupled at one end to the other said member for moving the other said member between advanced and retracted positions in response to rotation of said screw, the other end of said screw being formed with a plurality of flats forming a drive nut portion thereof, said base being adapted to rest upon a support surface, said support surface being spaced from the axis of said screw and drive nut portion, and operating means for rapidly rotating said vise screw, said operating means having an annular head of rigid material, a socket formed within said head to include a plurality of flats corresponding to the first named flats, said socket receiving said drive nut portion in a manner supporting said operating means therefrom, a handle including an elongate shank rigidly fixed to said head for rotating said socket, said handle extending diagonally away from the axis of said screw, the free end of said handle overlying the support surface, said handle when carried by said drive nut portion being rotatable continuously through 360° while the free end remains above said support surface to permit uninterrupted continuous rotation of said socket and handle for rotation of the vise screw.

2. In a vise assembly comprising a base, a pair of jaw members, one of said members being fixed with respect to said base, the other said member being movable between advanced and retracted positions with respect to said fixed member, an elongate vise screw threadedly coupled at one end to the other said member for moving the other said member between advanced and retracted positions in response to rotation of said screw, the other end of said screw being formed with a drive nut portion thereon, the underside of said base lying in a plane and adapted to rest upon a support surface, said support surface being spaced from the axis of said screw and drive nut portion, and operating means for rapidly rotating said vise screw, said operating means having an annular body of rigid material, a socket formed within said body to receive said drive nut portion therein in a manner supporting said operating means therefrom, said operating means including an elongate handle, said handle being rigidly integral to and extending from said body at a fixed angle permitting the free end of the handle to provide uninterrupted continuous rotation through 360° with said support surface underlying the free end of said handle.

3. In a vise assembly comprising a base, a pair of jaw members, one of said members being fixed with respect to said base, the other said member being movable between advanced and retracted positions with respect to said fixed member, an elongate vise screw threadedly coupled at one end of the other said member for moving the other said member between advanced and retracted positions in response to rotation of said screw, the other end of said screw being formed with a drive nut portion thereon, the underside of said base lying in a plane and adapted to rest upon a support surface, said support surface being spaced from the axis of said screw and drive nut portion, an operating means for rapidly rotating said vice screw, said operating means including first and second annular bodies of rigid material, a socket formed in each annular body for receiving said drive nut portion therein in a manner supporting said operating means therefrom, said operating means further including an elongate handle, said handle being rigidly integral to the first and second annular bodies and extending from said first annular body at a fixed angle permitting the free end of the handle to provide uninterrupted continuous rotation through 360° with said support surface underlying the free end of said handle, the axes of the first and second sockets defining an angle lying substantially between 70° and 85°, the axis of rotation of the socket in said second annular body being disposed substantially normal to the handle, said handle extending at a first angle to the axis of rotation of said drive nut portion when carried therefrom by said first annular body and at a second angle displaced substantially between 70° and 85° from said first angle when carried from said drive nut portion by said second annular body.

* * * * *